United States Patent [19]

Brüderlein

[11] 4,269,703

[45] May 26, 1981

[54] SCREENING MACHINE

[75] Inventor: Johannes Brüderlein, Duisburg, Fed. Rep. of Germany

[73] Assignee: Siebtechnik GmbH, Fed. Rep. of Germany

[21] Appl. No.: 19,988

[22] Filed: Mar. 12, 1979

[30] Foreign Application Priority Data

Mar. 11, 1978 [DE] Fed. Rep. of Germany ..... 2810587

[51] Int. Cl.[3] ..... B07B 1/06; B07B 1/28

[52] U.S. Cl. ..... 209/243; 209/310; 209/275; 74/86

[58] Field of Search ..... 209/275, 278, 279, 310, 209/360, 361, 363, 364, 302, 365, 332, 301, 366, 366.5, 437, 438, 504, 451, 453, 396, 243, 309; 74/86, 570; 210/388

[56] References Cited

U.S. PATENT DOCUMENTS

| | | | |
|---|---|---|---|
| 456,584 | 7/1891 | Morse | 209/275 X |
| 674,286 | 5/1901 | Stubbs | 209/310 |
| 807,423 | 12/1905 | Fern | 209/275 X |
| 1,108,616 | 8/1914 | Pettibone | 209/279 |
| 1,123,168 | 12/1914 | Combs | 74/86 X |
| 2,370,760 | 3/1945 | Fowler | 74/570 |
| 2,974,799 | 3/1961 | Gray | 209/438 X |
| 3,647,068 | 3/1972 | Wehner | 209/310 |
| 3,971,715 | 7/1976 | Wehner | 209/310 |
| 4,088,510 | 5/1978 | Betteroust | 209/396 |

FOREIGN PATENT DOCUMENTS

| | | | |
|---|---|---|---|
| 77591 | 11/1918 | Austria | 209/275 |
| 241360 | 12/1910 | Fed. Rep. of Germany | 209/279 |
| 239661 | 9/1925 | United Kingdom | 209/315 |

*Primary Examiner*—Robert Halper

*Attorney, Agent, or Firm*—Reed, Smith, Shaw & McClay

[57] ABSTRACT

A screening machine in which screens or portions of screens of elastic material and having substantially the shape of conical frustums are arranged one below the other. The circular edges of the screens are supported by holders which are mounted to a rotating shaft by means of bearings. The bearings of alternate holders being mounted on eccentric crank pins to drive such holders, without their rotating, in a substantially circular horizontal oscillatory motion to impart to each screen a rapid vibratory motion in which every section thereof participates. The vibratory motion results from a portion moving into and out of tension in conjunction with the rotation of eccentric crank pins.

7 Claims, 1 Drawing Figure

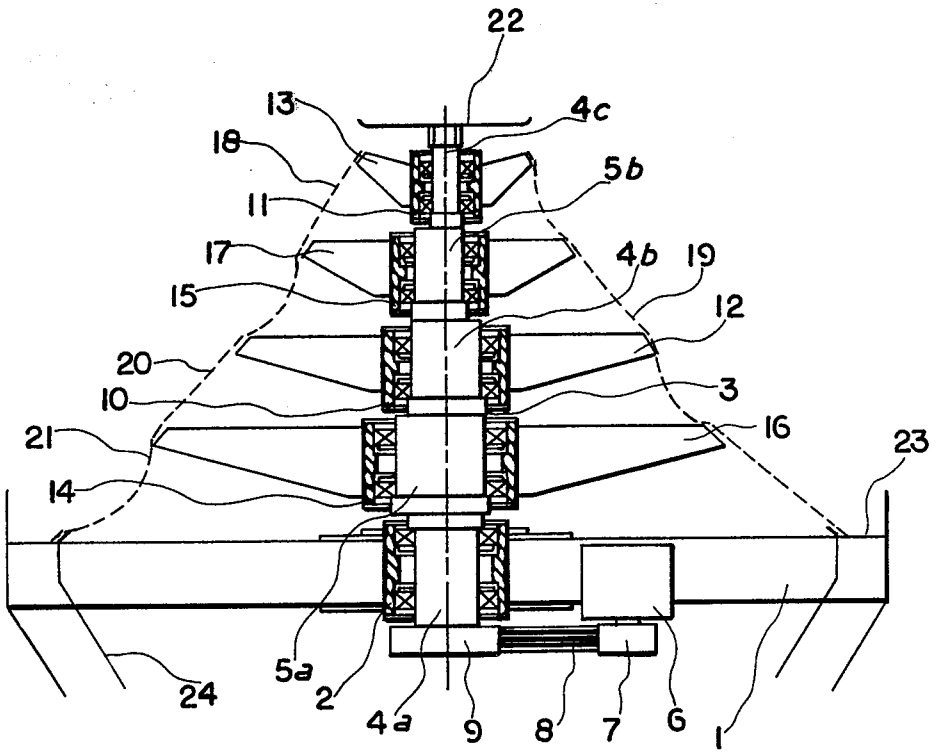
22
4c
5b
4b
19
12
3
16
23
1
6
7
8
9
4a
2
5a
24
14
21
10
20
15
17
11
18
13

SCREENING MACHINE

FIELD OF THE INVENTION

The invention relates to a screening machine having at least two screens which are arranged one below the other and each of which have substantially the shape of conical frustum envelopes expanding in a common direction.

BACKGROUND OF THE INVENTION

Screening machines utilizing a plurality of frustum conical screens are well known. Early screening machines of this kind, for example German Auslegeschrift No. 12 32 005, incorporate frustro-screens which are stationary. The material to be seived is introduced substantially in the form of a suspension tangentially with a charging velocity that allows the suspension to follow a helical path on its decent along the internal screen surface. Also suggested were screening machines wherein a frustro-conical screen barrel was rotated. See, e.g. German Patent Specification No. 816,051. These prior screening machines, however, were not suitable for high throughputs of moist material.

In those cases where screening is difficult, such as large throughputs of moist material, special screening machines have been proposed which operate on the principle of high speed thin film (layer) screening. These machines are typically fitted with a movable elastic screening deck, a mechanically moved screening deck, or a special tapping device or the like.

For the achievement of high screening capacity, it is desirable that the screening deck provide vibratory motion over practically its entire surface. Dead zones or zones devoid of vibratory motion on screening deck surface is undesirable.

One such device for providing high accelerations on vibratory screens was disclosed in German Patent Specification No. 12 06 372. That device included at least two screen frame systems which moved relative to one another. The grate bars meshed in pairs and were joined by screening deck elements that movably linked to the bars. The deck elements bridged the space between the bars which were spaced sufficiently far apart so as to allow their relative movement in relation to each other. The relative movement of the grate bars occurred at right angles to their length so as to produce therebetween zones of continuously varying widths. The screen positioned between the bars would alternate or vary in tension as a function of the properties, design and construction of the selected elastically stretchable screening sheets. The disadvantage of this device is the need for two opposing drive systems to produce the relative motion between adjacent bars to generate the so-called "springboard effect" or "trampoline effect" of the screen.

In German Auslegeshrift No. 21 03 098 there is disclosed a vibratory screen having a stretched screening deck of elastically stretchable material. The screen is held only at its edges which are at right angles to the conveying direction. Attached to the deck are transverse members which are driven together with the deck.

When such machines as those described are designed for high feed rates and throughputs, they tend to become extremely heavy so that correspondingly high static and dynamic loadings occur in the region of the support structure. These loadings are transmitted to the buildings in which they are housed creating difficult structural problems. Moreover, when the screening machines are fitted with positively moved elastic screening decks or screening sheets, optimum operation, especially where continuous operation is required, is not attained because their elaborate mechanical construction is subject to frequent breakdowns.

An improvement was proposed in such devices in German Patent Specification No. 1 757 423 where a screening machine having a substantially horizontally held nonrotating circular screen is disclosed which has imparted to it a substantially circular horizontal vibratory motion as well as a vertical vibratory component by means of an eccentric drive.

Notwithstanding the numerous types of screen devices proposed or available, few are capable of high throughputs of moist material. Those which are, have complicated mechanical components. Accordingly, it is an object of the present invention to provide a screening machine which can be constructed for the treatment at high throughput rates of moist charge material. It is a further object to provide such a machine which is relatively uncomplicated and requires only one drive system to achieve rapid vibratory motions or high accellerations of a screening deck. It is yet a further object to provide a machine in which a mass of material undergoing screening is kept as small as possible through high vibratory energy.

SUMMARY OF THE INVENTION

Generally, the screening machines of the present invention comprise at least two essentially elastic screens which are arranged one below the other. Each screen has a substantially frustro-conical shape, that is the envelope formed on the screen is a conical frustum, and each of which expand in a common direction. Preferably, the upper diameter of one conical frustum envelope substantially corresponds to the lower diameter of the adjacent conical frustum envelope.

The present invention also includes at least two holders which are mounted on a rotatable shaft. One of said holders is mounted by means of a bearing to a shaft journal and the other holder is mounted by means of an eccentric crank pin. The holders are preferably shaped like a spoked wheel to which are positioned the circular base of a bearing to the screen envelopes. The circular base edges of successive screens are mounted to the holders. The screens are mounted so that at least one edge of each screen describes a substantially circular horizontal oscillatory motion without being rotated.

The nonrotary substantially circular horizontal oscillation imparted upon the supported edge produces variations in the state of tension in each screen between the holders mounted to the shaft with the eccentric crank pin and those not so mounted. The oscillating motion continuously shortens or lengthens the screen. During the circular horizontal oscillation the most highly tensioned zone of the screening sheet or cloth or screen portion thus rotates in the rhythm of the circular oscillation and it does this specifically in the same way as the other zones in which the tension conditions vary. Thus, during each circular oscillation each section of the conical frustum shaped screening sheet is once stretched to a maximum extent and once relaxed to a maximum extent. A so-called "spring board effect" or "trampoline effect" is produced every time a given section of the screening sheet or cloth or screen portion goes from the fully relaxed condition to the fully stretched condition. This provides a rapid vibratory motion or high acceleration in the screening sheet in question.

A screening machine constructed in accordance with the present invention requires only a single drive system to generate the "spring board effect" or "trampoline effect". Further, the inertial forces occurring during the operation of the machine can be low because the number of moving parts is minimized. The entire surface of the screen participates in the vibratory motion thus optimizing the available screening capacity. Other advantages of the present invention will become apparent from a perusal of the following detailed description of a presently preferred embodiment taken together with the accompanying drawing which is a diagrammatic side elevation, partially in section, of a screening machine constructed in accordance with the invention.

PRESENTLY PREFERRED EMBODIMENT

Referring to the drawing, the screening machine comprises frame 1 which is mounted by bearing 2 to crank shaft 3. Crank shaft 3 includes shaft journals 4*a*, 4*b*, 4*c* which are alternately positioned along the length of the shaft with crank pins 5*a* and 5*b*. Crank pins 5*a* and 5*b* have a given eccentricity with respect to the axes of the shaft journals 4*a*, 4*b* and 4*c*. Frame 1 carries a drive motor 6 which drives crank shaft 3 through belt pulley 7, belt 8 and pulley 9 which is mounted on crank shaft 3.

Holders 12 and 13 are mounted on the shaft journals 4*b* and 4*c* by means of bearing devices 10 and 11. Holders 12 and 13 preferably are in the form of spoked wheels. Mounted to crank pins 5*a* and 5*b* by means of bearing devices 14 and 15 are holders 16 and 17 which are also preferably in the form of spoked wheels. Holders 16 and 17 describe a nonrotating, substantially circular, horizontal oscillatory motion around the axis of the shaft journals when crank shaft 3 is rotated.

As shown, the diameter of each holder increases progressively from the top to the bottom of the machine. Between adjacent holders are mounted screen 18, 19, 20, and 21. Preferably each of these screens have an envelope the shape of a conical frustum. The taper angles of each screen envelope may be either identical or different. The lower circular edge of the bottom conical frustum screen envelope 21 is held by frame 1.

The individual screens are preferably of an elastic material. At least the circular base edge of conical frustum envelopes 18, 19, 20 and 21 is movably supported by a holder 16 or 17 so as to describe a substantially circular horizontal oscillatory motion without rotation.

The individual screens 18, 19, 20 and 21 do not rotate when crank shaft 3 is driven. What happens is that when crank shaft 3 is rotated a tensioned or stretched zone and a relaxed zone of each screen travels in a circle around the shaft journal axis. The tensioned states of the individual screens vary continuously between the maximum stretched out and maximum relaxed states. The zone of maximum stretch of each screen rotates at the speed of the crank shaft along with the eccentricity of crank pins 5*a* and 5*b*. This motion produces a very rapid vibration within each screen so that the entire screen surface participates in the vibratory motion without there being any dead zones. The frequency of the vibrations and the extent of acceleration on changeover from the relaxed state to the stretched state of the individual screen zones is a function of the speed of rotation of the crank shaft 3.

The screen is fed by means of a disk spreader 22 which can be excited to perform an additional tumbling motion through not-shown construction elements.

Oversize or coarser material is removed by means of a collection channel 23 adjoining the edge of the lower circumference of the lower screen 21 while undersized or finer material is collected by the collecting funnel 24.

In the case of the embodiment shown in the drawing the various conical frustum shaped screens become progressively larger in diameter so that the charge material is fed onto the outside of the frustum envelopes. Alternatively, it is possible to arrange the conical frustum shaped screens one below the other such that screen with the largest diameter tapers in a downward direction. Each screen would correspondingly taper for successive downward adjoining screens. The effect would be as if the screening machine shown in the drawing were, for all practical purposes, inverted. In such an arrangement, the charge material is fed into the inside of the frustum envelope of the uppermost screen.

It is also possible to arrange a plurality of screening machines constructed in accordance with the invention arranged one above the other; in this context, it is also possible to provide a combination of one screening machine with downwards expanding conical frustum envelopes with a screening machine with downwards tapering conical frustum envelopes or to provide the reverse.

While a presently preferred embodiment of the invention has been shown and described in particularity, it may be otherwise embodied within the scope of the appended claims.

What is claimed is:

1. A screening machine comprising:

a. a vertically disposed crank shaft and means for rotating said shaft;

b. a plurality of spaced apart holders, alternative holders being eccentrically, but nonrotatably, mounted to said crank shaft, and said other holders being nonrotatably mounted to said crank shaft; and c. a plurality of frustro-conical screens mounted to said holders and disposed between said holders such that rotation of said crank shaft imparts a substantially circular motion to the circular edges of the screens mounted to the eccentrically mounted holders.

2. A screening machine as set forth in claim 1 wherein said holders have a shape similar to a spoked wheel each having a diameter greater than the holder mounted above itself.

3. A screening machine as set forth in claim 2 wherein the diameters of the circular edges of successive frustro-conical screens increase from top to bottom and means for feeding a charge material into the outside of the uppermost screen is positioned above said uppermost screen.

4. A screening machine as set forth in claim 1 wherein the circular edges of the frusto-conical screens are fixed to holders which have substantially the form of spoked wheels.

5. A screening machine as set forth in claim 1 wherein there are an even number of successive frusto-conical screens and the top edge of the uppermost screen and the bottom edge of the lowermost screen are stationarily supported.

6. A screening machine as set forth in claim 1 wherein the tapered angles of successive frusto-conical screens differ.

7. A screening machine as set forth in claim 1 wherein the diameter of the successive conical frustum shaped screens become progressively smaller from top to bottom and means for feeding a charge material onto the inside surface of the uppermost screen is positioned above said screen.

* * * * *